United States Patent [19]

Williams

[11] Patent Number: 5,073,035

[45] Date of Patent: Dec. 17, 1991

[54] BULK CARRYING BAG

[76] Inventor: Kenneth J. Williams, 12 W. McCabe Rd., El Centro, Calif. 92243

[21] Appl. No.: 697,412

[22] Filed: May 9, 1991

[51] Int. Cl.[5] ..... B65D 33/02; B65D 33/14

[52] U.S. Cl. ..... 383/19; 383/17; 383/24

[58] Field of Search ..... 383/17, 18, 19, 119, 383/24; 220/9.1

[56] References Cited

U.S. PATENT DOCUMENTS

| | | | |
|---|---|---|---|
| 2,696,235 | 12/1954 | Toffolon | 383/18 |
| 2,815,784 | 12/1957 | Cunningham | 383/19 |
| 2,978,004 | 4/1961 | Smith | 383/19 |
| 3,044,515 | 7/1962 | Eades | 383/19 X |
| 4,390,051 | 6/1983 | Cuthbertson | 383/17 X |
| 4,966,310 | 10/1990 | Hawkins | 383/19 X |

OTHER PUBLICATIONS

Guide to Selecting Bulk Bags-Updated; Taylor Products Co., Inc.

*Primary Examiner*—Stephen Marcus
*Assistant Examiner*—Jes F. Pascua
*Attorney, Agent, or Firm*—Henri J. A. Charmasson

[57] ABSTRACT

A large bulk bag has an internal load-distributing and wall-shaping chain network which maintains the general quadrangular shape of the bag so that a maximum number of such bags can be loaded or stored over a given surface. The internal chain network can also be shaken to de-aerate the bulk content of the bag or break any caking of the material to expedite its unloading.

7 Claims, 2 Drawing Sheets

BULK CARRYING BAG

FIELD OF THE INVENTION

This invention relates to bags, and more specifically to large bags intended for carrying heavy loads of bulk material.

BACKGROUND OF THE INVENTION

Bagging of such materials as grain, seeds, fertilizer, feeds etc. is favored for shipping and storage over handling such goods in large bulk volume. The main advantage is that the product can be protected against dust, rain and other environmental hazards. Furthermore, the handling of bagged goods eliminates many losses due to spillage and dispersion by wind and air drafts. However, the bags of the prior art, due to their limited size and large number require considerable handling, and must be stacked on a pallet for loading and transportation. Those pallets add to the cost of shipping. While large bags with capacities up to 3 cubic meters which can be handled individually are currently used for some goods, those bags made of various types of fabrics tend to assume a rounded shape upon loading which results in a great loss of storage or cargo space when they are aligned side by side. Furthermore, the load capacity of a large bag is limited by the tensile and burst strength of their fabrics and reinforcing webs.

SUMMARY OF THE INVENTION

The principal and secondary objects of this invention are to provide large cargo bags for the storage and transportation of bulk goods in volume in excess of 4 cubic meters and loads in excess of 3 metric tons; to maintain a substantially quadrangular geometry of such bags when they are fully loaded; to provide a convenient means for vibrating and aerating the goods as they are loaded into such bags for maximum loading, and a convenient way to break up any caking of the bagged goods or material in order to expedite the unloading process.

These and other objects are achieved by placing inside the bag, a network of load distributing and shape-retaining lengths of chain or webbing which is suspended from the four upper corners of the bag where lifting rings are normally secured, and connected to the middle of the ribs which run along the corners and circle the bag at various heights.

DESCRIPTION OF THE PREFERRED EMBODIMENT OF THE INVENTION

Figure 1:
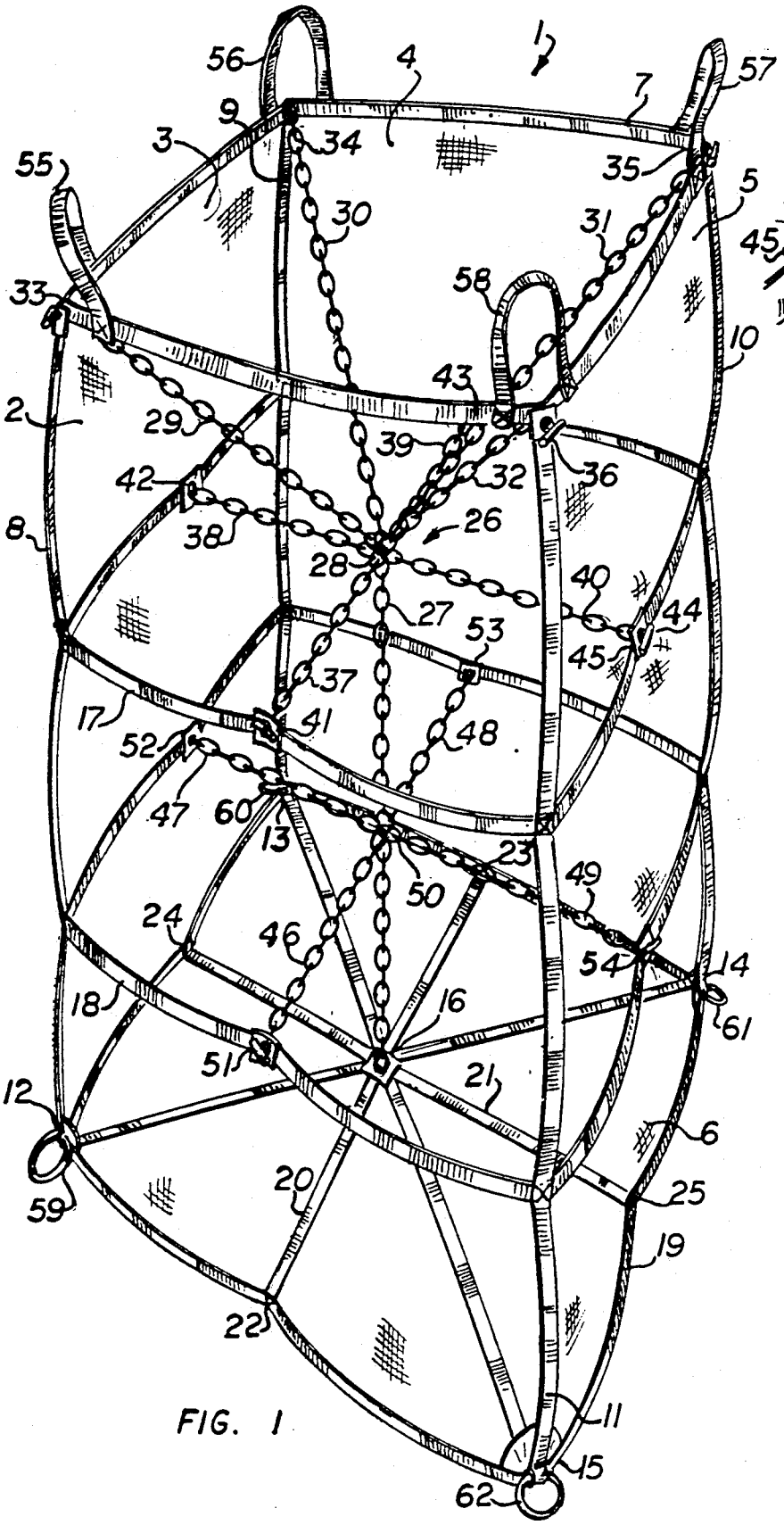
FIG. 1 is a perspective view of a large bulk-carrying bag according to the invention.

Referring now to the drawing, there is shown in FIG. 1 a bulk cargo bag designed to carry loads up to 4 metric tons and volumes up to 4 cubic meters. The bag 1 is made from quadrangular sheets of a high tensile and high burst strength material such as a woven polypropylene fabrics or heavy gauge burlaps making four rectangular walls 2, 3, 4, 5 and a square bottom 6. The fabric is only suggested on the drawing and shown transparent in order to expose the entire armature and load-distributing structure of the bag. The armature comprises reinforcing webs made of woven nylon or other high tensile strength material. A first web 7 lines the rim of the bag. Four webs 8, 9, 10, 11 are stitched along the vertical corners of the walls then extend from the bottom corners under the bag to meet at the center 16 of the bottom 6. Two horizontal webs 17, 18 form girdles around the bag at $\frac{1}{3}$ and $\frac{2}{3}$ of its height. A bottom web 19 is stitched to the horizontal bottom corners of the bag. Two cross-webs 20, 21 brace the bottom by joining the opposite mid-points 22, 23, and 24, 25 of opposite bottom, horizontal corners.

Inside the bag, a network 26 of load-distributing and side-shaping elements is made from various chain lengths. A central element 27 has its upper extremity connected to node 28 at approximately the level of the uppermost girdle 17, and run down axially to connect to the center 16 of the bottom 6 of the bag. The node 28 is a junction of four oblique chain segments 29, 30, 31, 32 which are attached at their distal ends to the upper corner area 33, 34, 35 and 36 of the bag. From the node 28, four horizontal chain segments 37, 38, 39, 40 are attached at their distal ends to the middle of each side section 41, 42, 43, 44 of the uppermost girdle 17. Another set of horizontal chain segments 46, 47, 48, 49 extend from a second node 50 also on the first segment 27 at the level of the lower girdle 18, toward midpoints 51, 52, 53, 54 of each wall segment of the lower girdle 18.

Lifting loops 55, 56, 57, 58 are attached to the upper corner areas 33, 34, 35, 36. Anchoring rings 59, 60, 61, 62 are secured to the four lower corners 12, 13, 14, 15.

Figure 2:
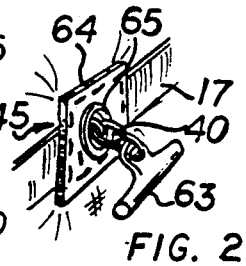
FIG. 2 is a perspective view of the attachment of the load-distributing and side-shaping chains to the walls and corners of the bag.
Figure 3:
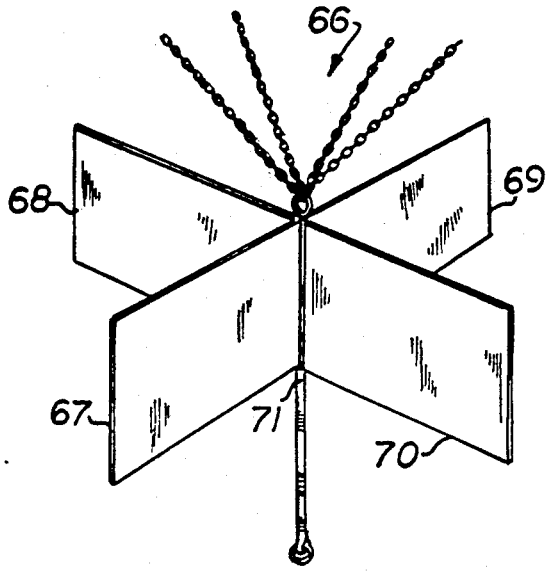
FIG. 3 is a perspective view of a first alternate embodiment of the load-distributing structure.

FIG. 2 illustrates the attachment of each distal end of a chain segment to the various ribs and girdles. The illustrated typical attachment point 45 of chain segment 40 to the girdle 17 is shown. The most distal link of the chain segment 40 is engaged in a loop which forms the central post of a T-shaped retaining element 64. The element has been passed through an aperture in a reinforcing patch 64 which is stitched to the girdle 17 and the fabric of the bag. The aperture is reinforced by an eyelet 65. It can now be understood, that the chain network can be quickly disconnected and removed when the bag is sent for cleaning, or because the weight or nature of the load does not necessitate the use of the load-distributing and shaping structure 26.

The first role of the chain segment structure 26 is to distribute a large part of the load to the four upper corners 33, 34, 35, 36 where the lifting loops are located. The second role of the innermost structure 26 is to limit the rounding of the side walls 2, 3, 4, 5 during loading in order to preserve the quadrangular, space-saving shape of the bag. The third role of the structure 26 is to provide a convenient means for shaking the material or goods as they are loaded into the bag to expedite deaeration of powders and the compacting of any other material. Yet, a fourth role of the structure 26 is to provide a convenient means for vibrating the contents of the bag during unloading to break up any caking or adhesion of the contents and expedite the unloading.

The first alternate embodiment 66 of the load-distributing structure uses four webs 67, 68, 69, 70 of fabric in lieu of the two sets of horizontal chain segments to prevent excessive rounding of the walls. The original suspension with oblique chain segments has been preserved. In this embodiment, the distal ends of each web must be stitched vertically to the walls between the two median points of each quarter-segment of the girdles. A fabric strap 71 is used to link the node at the convergence of the four oblique chain segments to the cross-line of the webs and the bottom of the bag.

Figure 4:
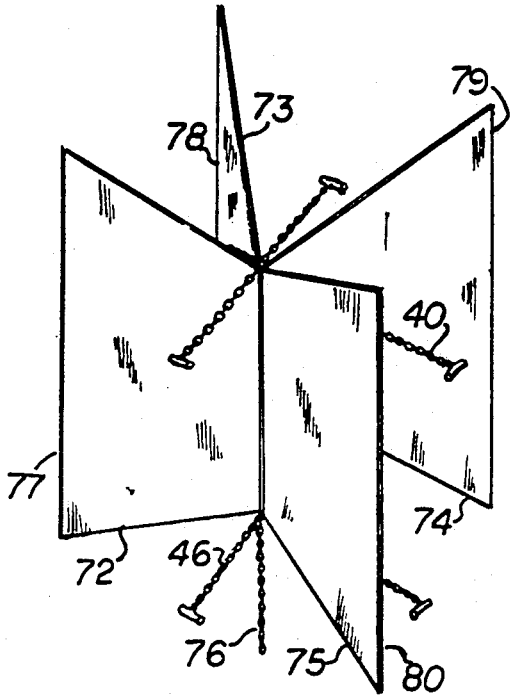
FIG. 4 is a second alternate embodiment of the load-distributing structure.

The second alternate embodiment illustrated in FIG. 4 uses trapezoidal webs 72, 73, 74, 75 in lieu of the oblique chain segment to distribute the load, but retain the horizontal chain segments 37, 38, 39, 40 and 46, 47, 48, 49 of the first embodiment, as well as a lower segment 76 of the chain connected to the bottom of the bag. The distal edges 77, 78, 79, 80 of the nibs are sewn to the internal, vertical corners of the bag.

Figure 5:
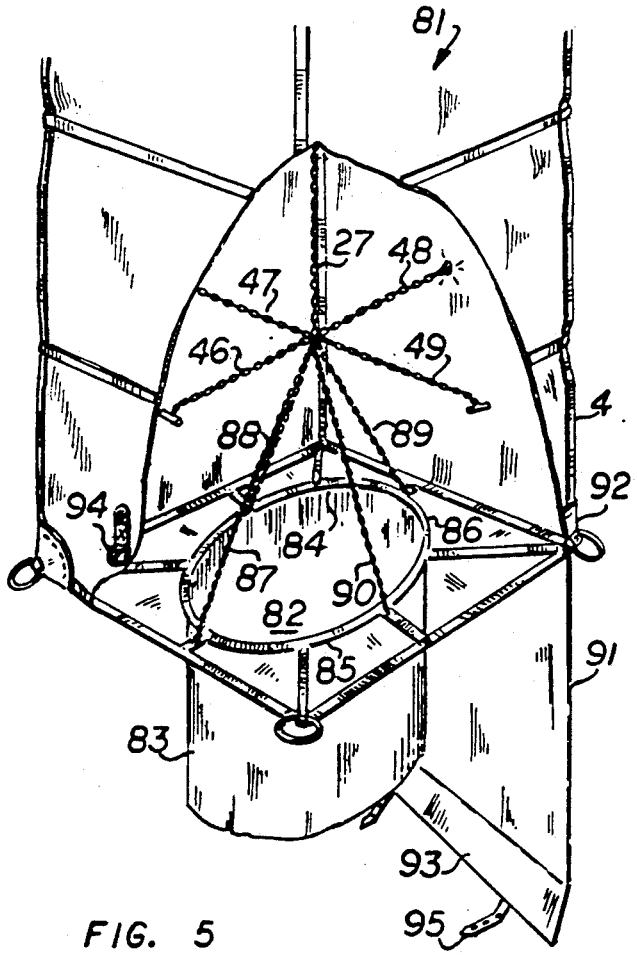
FIG. 5 is a perspective view of the bottom section of a bag featuring an unloading spout.

Seen through the cut-away portion of the bottom section of a bag 81 illustrated in FIG. 5, is a discharge opening 82 and discharge spout 83. The rim 84 of the opening is formed by a rigid circular frame 85 encased into a web 86 to which all the other ribs and reinforcing web which in the embodiment of FIG. 1 converges to the bottom center 16 are attached. The vertical, central chain segment 27 which also at it lower extremity, attaches to the bottom center in the first embodiment, splits into four segments 87, 88, 89, 90 at the node joining the lowest set of horizontal segments 46, 47, 48, 49. The lower ends of the four splitting segments are attached to the rim of the opening. The spout 83 is formed by a sock which eliminates dust when emptying the bag. The spout 83 can be twisted and folded for closure and kept in place by a flap 91 which has one edge 92 permanently stitched to the bottom edge of a wall, and at its opposite edge 93 is attachable to the opposite wall by means of buckle and strap 85 fasteners.

It should be noted that a similar opening and spout can be provided in a top closing the upper section of the bag. The amount of reinforcing webbing may have to be increased to provide additional reinforcement and support depending upon the load and type of fabric. The selection of a woven fabric which allows for some degree of aeration of the goods is preferred over impermeable ones.

While the preferred embodiments of the invention have been described, modifications can be made and other embodiments may be devised without departing from the spirit of the invention and the scope of the appended claims.

What is claimed is:

1. A bag for transporting goods in bulk which comprises:

a container made from rectangular sheets of pliable material, said container having four walls defining four vertical corners and a quadrangular bottom forming four horizontal corners with said walls;

reinforcing webs secured to said sheets, including four ribs running along said corners, and at least one horizontal girdle surrounding a median section of said container; and a load-distributing network of lengths of tensionresistant material including;

a first member running axially down the center of the container, four suspending members, each extending down obliquely from an upper area of one of said vertical corners to the upper end of the first member, and four shaping-members extending horizontally from the first member to contact the girdle in a median section of one of said walls.

2. The bag of claim 1 which further comprises four lifting loops, each secured to an upper section of one of said vertical corners.

3. The bag of claim 2, wherein said lengths of tension-resisting material comprise lengths of chain.

4. The bag of claim 3, wherein said length of tension-resisting material comprise webs of pliable material.

5. The bag of claim 3, wherein the lower end of the first member is attached to said bottom.

6. The bag of claim 5, wherein said bottom has a closable unloading opening.

7. The bag of claim 5, wherein each of said length of chain comprises T-shaped member attached to its distal end and engaged into an eyelet in one of said reinforcing webs.

* * * * *